US007499856B2

(12) United States Patent
Takahashi et al.

(10) Patent No.: US 7,499,856 B2
(45) Date of Patent: Mar. 3, 2009

(54) ESTIMATION METHOD AND APPARATUS OF OVERALL CONVERSATIONAL QUALITY TAKING INTO ACCOUNT THE INTERACTION BETWEEN QUALITY FACTORS

(75) Inventors: Akira Takahashi, Tokorozawa (JP); Jun Okamoto, Kodaira (JP); Ginga Kawaguti, Tokyo (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 1088 days.

(21) Appl. No.: 10/740,642

(22) Filed: Dec. 22, 2003

(65) Prior Publication Data

US 2004/0186731 A1 Sep. 23, 2004

(30) Foreign Application Priority Data

Dec. 25, 2002 (JP) ..... 2002-373930

(51) Int. Cl.
*G10L 21/00* (2006.01)

(52) U.S. Cl. ..... 704/228

(58) Field of Classification Search ..... 704/228
See application file for complete search history.

(56) References Cited

U.S. PATENT DOCUMENTS 6,370,120 B1 4/2002 Hardy
6,965,597 B1 * 11/2005 Conway ..... 370/389
7,076,316 B2 * 7/2006 Rabipour et al. ..... 700/94

FOREIGN PATENT DOCUMENTS

| | | |
|---|---|---|
| EP | 1 187 100 | 3/2002 |
| JP | 6-195039 | 7/1994 |
| JP | 6-236198 | 8/1994 |
| JP | 2002-64539 | 2/2002 |
| JP | 2004-535710 | 11/2004 |
| WO | WO 02/098030 A1 | 12/2002 |

OTHER PUBLICATIONS

A. W. Rix, et al., IEEE International Conference on Acoustics, Speech, and Signal Processing, vol. 3, XP-010507639, pp. 1515-1518, "The Perceptual Analysis Measurement System for Robust End-To-End Speech Quality Assessment", Jun. 5-9, 2000.

(Continued)

*Primary Examiner*—Talivaldis I Smits
(74) *Attorney, Agent, or Firm*—Oblon, Spivak, McClelland, Maier & Neustadt, P.C.

(57) ABSTRACT

The delay time and listening quality of a system under test are measured from a signal received therefrom, then the measured delay time and listening quality are transformed to a delay-related degradation and a listening quality degradation on the same quality measure, then the quantity of interaction between the delay-related degradation and the listening quality degradation is calculated, and the delay-related degradation, the listening quality degradation and the quantity of interaction are added together to obtain an overall degradation. The overall degradation is transformed to a subjective evaluation value to estimate the overall speech quality.

18 Claims, 6 Drawing Sheets

OTHER PUBLICATIONS

A. E. Conway, et al., Proceedings Eleventh International Conference on Computer Communications and Networks, XP-01061010868, pp. 116-123, "Applying Objective Perceptual Quality Assessment Methods in Network Performance Modeling", Oct. 14-16, 2002.
"Methods for Subjective determination of Transmission Quality", International Telecommunication Union, ITU-T Recommendation P.800, Aug. 1996, (45 pgs).
"Perceptual Evaluation of Speech Quality (PESQ): An Objective Method for End-to-End Speech Quality Assessment of Narrow-Band Telephone Networks and Speech CODECS", International Telecommunication Union, ITU-T Recommendation P.862, Feb. 2001, (28 pgs).
"The E-Model, A Computational Model For Use in Transmission Planning", International Telecommunication Union, ITU-T Recommendation G. 107, Mar. 2003, (23 pgs).
"Appendix I: Provisional Planning Values for the Equipment Impairment factor /E and Packet-Loss Robustness Factor Bpl", International Telecommunication Union, ITU-T Recommendation G.113, May 2002, (6 pgs).
"Pulse Code Modulation (PCM) of Voice Frequencies", International Telecommunication Union, ITU-T Recommendation G.711, (12 pgs), 1993.
Tetsuro Yamazaki, et al., "Proposal of Objective Assessment Method for Telecommunication Speech Quality Using Pattern Recognition Technique", The Institute of Electronics, Information and Communication Engineers, Technical Report of IEICE SP92-94, Nov. 1992, pp. 17-24.
"Modulated Noise Reference Unit (MNRU)", International Telecommunication Union, ITU-T Recommendation P. 810, Feb. 1996, (13 pgs).
Kenzou Itoh, et al., "Delay-Related Quality Evaluation Method Using Temporal Features of Conversational Speech", Journal of the Society of Acoustics Engineers of Japan, col. 43, No. 11, Apr. 1987, pp. 851-857.
Ginga Kawaguti, et al., "Subjective quality evaluation of conversation test with wide-band speech codec", Proceedings of the 2000 IEICE General Conference, B-11-21, Vol. 2, Mar. 7, 2000, p. 592.
T. Kansai, "Speech Quality Evaulation on IP-Phone: Are there differences in precision among measurement methods? Is it easy to use a new "R-value"?", Nikkei Communications, Nikkei Business Publications, Inc., No. 336, May 20, 2002, pp. 96-102.
T. Kikuchi, et al., "Battles Under the Flags of "050" For Telephone Realms", Nikkei Electronincs, Nikkei Business Publications, Inc., No. 829, Aug. 26, 2002, pp. 109-135.

* cited by examiner

ESTIMATION METHOD AND APPARATUS OF OVERALL CONVERSATIONAL QUALITY TAKING INTO ACCOUNT THE INTERACTION BETWEEN QUALITY FACTORS

BACKGROUND OF THE INVENTION

The present invention relates to a method for estimating the speech quality in telephony services and, more particularly, to an overall conversational speech quality estimation method and apparatus for estimating the subjective conversational speech quality from measured quantities of physical features of a system under test without conducting subjective evaluation tests for evaluating the actual conversational speech quality in the IP telephony; furthermore, the invention also pertains to a program for implementing the method and a recording medium with the program stored thereon.

PRIOR ART

In recent years, industry attention has focused on "IP telephony services" (VoIP: Voice over IP (Internet Protocol)) which are implemented using IP technology. Since the IP telephony services are real-time telecommunication services via systems that do not necessarily guarantee the conversational speech quality, the quality designing of IP telephony prior to and quality management after inauguration of its services are both requisite for stable operation. To this end, it is of importance to develop a simple and efficient quality evaluation scheme capable of appropriate description of the speech quality that users enjoy.

The basic evaluation of the speech quality in the IP telephony services is the subjective evaluation that quantitatively evaluates the actual subjective quality users experience during IP telephony applications by psychological experiments. For the subjective evaluation there is widely used the opinion test defined in ITU-T Recommendation P.800. In this method the actual subjective quality rated on a 1-to-5 scale is given as a mean value, which is called MOS (Mean Opinion Score). Among such MOS values there are, for example, a conversational MOS that is an overall speech quality estimate including a conversational quality factor, and a listening MOS based only on the listening quality.

Since the opinion test actually evaluates the speech quality by humans, the MOS values are regarded as the most appropriate ratings of the speech quality users felt while they received the services concerned. Because of subjective evaluation, however, the opinion test calls for much labor and time and dedicated evaluation equipment, and hence the scheme is not necessarily easy to implement and is particularly difficult to use for the quality management of the IP telephony after inauguration of its operation. In view of this, studies are being made of a scheme that utilizes physical quantities of features of telecommunication to estimate MOS values obtainable by the opinion evaluation. This scheme is called a "objective evaluation method" in contrast to the subjective evaluation method, and for this objective evaluation method there are proposed several variations according to its purpose and approach.

The PESQ (Perceptual Evaluation of Speech Quality) method defined in ITU-T Recommendation P.862 is an objective evaluation method based on physical measurement of an actual speech signal; under certain conditions this method is capable of estimating the subjective speech quality with an estimation error about the same as statistical confidence interval of the subjective evaluation. The PESQ method is effective in estimating the listening MOS, but it is, in principle, unable to estimate conversational quality factors such as delay and echo.

On the other hand, the E-model defined in ITU-T Recommendation G 107 is an overall communication speech quality estimating technique including the conversational quality factors. The E-model is one that expresses degradations by individual quality factors such as listening quality, delay and echo, on the psychological scale and adds these degradations together, and the model is expressed by the following equation.

$$R=Ro-Is-Id-Ie,eff+A \quad (1)$$

A basic signal to noise ratio Ro represents the subjective quality degradation by circuit noise, sender/receiver room noise and subscriber line noise. An simultaneous impairment factor evaluation value Is represents the subjective quality impairment due to loudness, side tone, and quantizing distortion. A delay-related impairment factor estimation value Id represents the subjective quality impairment due to talker echo, listener echo and pure delay. An equipment impairment factor evaluation value Ie,eff represents the subjective quality impairment due to low-bitrate CODEC and packet/cell loss. An advantage factor evaluation value A complements the influence of the advantage as of mobile communications on the subjective quality (level of satisfaction).

The E-model is based on the hypothesis that these quality degradations can be simply added together on the psychological scale. In the case of estimating the overall speech quality including impairment factors that produces an effect inexplainable with the simple additive model the E-model assumes, the E-model estimates may sometimes be divergent from the actual subjective quality users experience.

SUMMARY OF THE INVENTION

It is therefore an object of the present invention to provide a method and apparatus that obviates the problem of reduced estimation accuracy by a failure of the hypothesis of the existing E-model, and permit implementation of high-accuracy estimation of the overall conversational quality.

According to the present invention, a method for estimating the speech quality of a system under test that has a plurality of quality impairment factors, comprising the steps of:

(a) measuring primary evaluation values of said quality impairment factors of said system based on a signal received from said system;

(b) transforming the primary evaluation values of said quality impairment factors to psychological degradations (values on the psychological scale);

(c) calculating the quantity of interaction between the psychological degradations by at least two of said plurality of quality impairment factors;

(d) calculating the sum of said psychological degradations and said quantity of interaction as an overall degradation; and (e) transforming said overall degradation to a subjective quality evaluation value.

According to the present invention, an overall speech quality estimation apparatus for estimating the speech quality of a system under test that has a plurality of quality impairment factors, said apparatus comprising:

quality measuring means for measuring primary evaluation values of said quality impairment factors of said system based on a signal received from said system;

transforming means for transforming said primary evaluation values of said quality impairment factors to psychological degradations (values on the psychological scale);

quantity-of-interaction calculating means for calculating the quantity of interaction between said plurality of quality impairment factors from the output value from said transforming means;

adding means for adding said primary evaluation values and said quantity of interaction to obtain an overall degradation; and overall speech quality estimating means for transforming said overall degradation to a subjective quality evaluation value.

By taking into account the interaction between at least two quality impairment factors as described above, it is possible to provide increased estimation accuracy of the overall speech quality.

DETAILED DESCRIPTION OF THE PREFERRED EMBODIMENT

Embodiment 1

Figure 1:
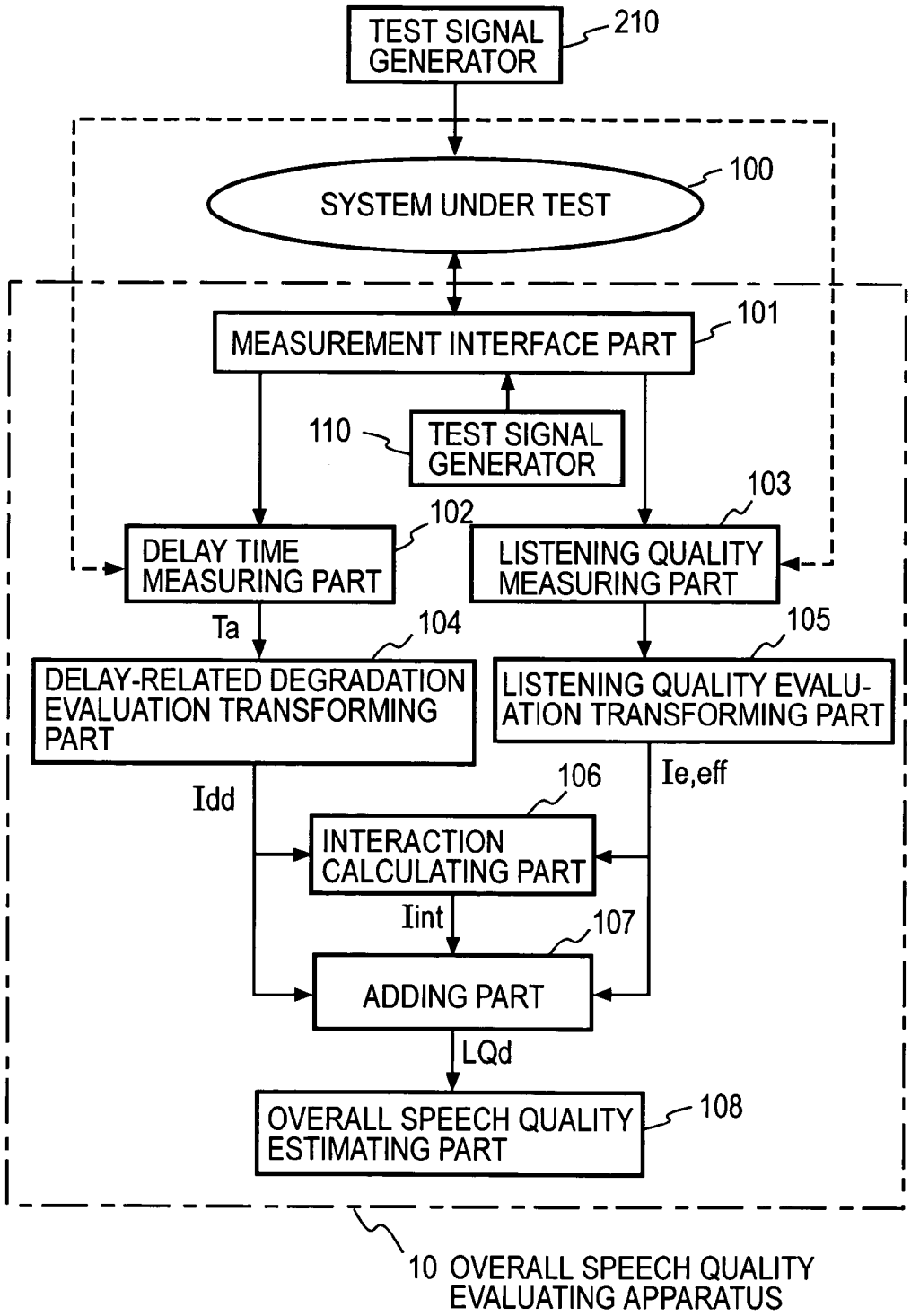
FIG. 1 is a block diagram illustrating the configuration of a first embodiment of the overall speech quality estimating apparatus according to the present invention.

FIG. 1 is a block diagram illustrating the device configuration for implementing the overall speech quality estimating method according to the present invention. The present invention is applicable to the estimation of the speech quality in a system under test 100, for example, in fixed or IP telephony services. This embodiment handles, as the quality factors for estimating the speech quality, delay and listening quality that greatly affect the quality designing of the system 100, and the evaluation output is an estimate of the overall speech quality in the case of these factors being compounded.

In FIG. 1, reference numeral 1 denotes generally an embodiment of the overall speech quality evaluating apparatus according to the present invention. The evaluating apparatus 10 comprises: a measurement interface part 101 which sends an receives test signals via the system to be estimated 100; a delay time measuring part 102 and a listening quality measuring part 103 which, based on signals received from the system 100, measure primary evaluation values of quality factors, that is, measure a transmission delay time and a listening quality degradation or impairment factor of the system 100 as primary evaluation values, respectively; a delay-related degradation evaluation value transforming part 104 and a listening quality evaluation value transforming part 105 which convert the measured outputs from the measuring parts 102 and 103 to a delay-related degradation Idd and a listening quality degradation Ie,eff that are measures or indices representing psychological distances that can be added together; an interaction value calculating part 106 which calculates the value of an interaction, Iint, between the delay-related degradation Idd and the listening quality impairment Ie,eff; an adding part 107 which calculates an overall speech quality index LQd by adding together the delay degradation Idd, the listening quality degradation Ie,eff and the interaction value Iint; and an overall speech quality estimating part 108 which transforms the output index LQd from the adding part to a subjective speech quality evaluation value (for example, mean opinion score obtainable by a subjective evaluation test).

According to the method actually used for measuring delay time and listening quality, the test signal for measurement is generated by a test signal generating part in the overall speech quality estimating apparatus 10, or by a test signal generator 210 connected to the system 100 outside the quality estimating apparatus 10.

First delay time measuring method: The delay time measuring part 102 calculates a one-way delay time Ta caused by the system 100 by comparing a timestamp contained in control information (for example, an RTP header in VoIP) of the speech signal the measurement interface part 101 received from the test signal generator 210 with the actual signal receiving time. This method calls for temporal synchronization between the send and receive sides.

Second delay time measuring method: When no temporal synchronization is achieved, the delay time measuring part 102 uses RTCP (RTP control protocol: a protocol for controlling RTP transmission) to calculate a round trip delay time Td between it and an arbitrary receive terminal (not shown) connected to the system 100, and obtains the one-way delay time Ta=Td/2.

Third delay time measuring method: Alternatively, the delay time measuring part 102 calculates the round trip delay time Td between the receive side to the send side by sending Ping (Packet InterNet Groper) from the former to the latter, and obtains the one-way delay time Ta=Td/2.

The delay-related degradation evaluation transforming part 104 follows predetermined rules to obtain the degradation by delay, that is, the delay-related degradation Idd from the one-way delay time Ta measured by the delay time measuring part 102. More specifically, in the E-model defined in ITU-T Recommendation G. 107 the delay-related degradation is defined by the following equations based on the relation between a speech delay time obtained by experiments and the corresponding subjective speech evaluation value (Mean Opinion Score MOS defined in UTU-T Recommendation P.800).

$$Idd=0 \text{ for } Ta \leqq 100 \text{ ms} \tag{2}$$

$$Idd=25\{(1+X^6)^{1/6}-3(1+[X/3]^6)^{1/6}+2\} \text{ for } Ta>100 \text{ ms} \tag{3}$$

where $$X=\frac{1g(Ta/100)}{1g2}$$

Alternatively, the following equation may be sued in place of Eqs. (2) and (3).

$$Idd=b_1Ta^2+b_2Ta \tag{4}$$

Where $b_1$ and $b_2$ are constants.

A description will be given below of the measurement of the listening quality impairment factor by the listening quality measuring part 103 and three variations of the method for obtaining the listening quality degradation Ie,eff from the measured listening quality impairment factor by the listening quality evaluation transforming part 105 (a listening quality evaluation method).

First Listening Quality Evaluation Method In the E-model defined in ITU-T Recommendation G.107 the quality degradation Ie,eff is formulated as follows:

$$Ie,\ eff = Ie + (95 - Ie)\frac{Ppl}{Ppl + Bpl} \tag{5}$$

where Ie represents a quality degradation by speech coding, Ppl the packet loss probability, and Bpl the packet-loss robustness of the coding system. As the speech coding system, there are available, for example, PCM, ADPCM, A-CELP (Algebraic Code Excited Linear Prediction), MP-MLQ (MultiPulse Maximum Likelihood Quantization), CS-ACELP (Conjugate Structure Algebraic Code Excited Linear Prediction) coding systems. Regarding these coding systems, ITU-T Recommendation G.113 Appendix I shows quality degradations Ie by coding and the packet-loss robustness values Bpl of the coding systems. In the first listening quality evaluation method, the listening quality measuring part 103 measures the packet loss probability Ppl of the received signal as a listening quality impairment factor and determines the values Ie and Bpl by referring to the above-mentioned ITU-T Recommendation G.113 Appendix I according to the kind of the coding system obtained a priori, and the listening quality evaluation value transforming part 105 calculates the listening quality degradation Ie,eff by Eq. (5).

Second Listening Quality Evaluation Method

In ITU-T Recommendation P.862 there is shown how to obtain PESQ (Perceptual Evaluation of Speech Quality) value. The basic procedure begins with measuring spectra of an impaired speech signal having passed through the system under measurement and the original speech signal having not passed through the system, followed by obtaining a difference between the measured spectra, and then followed by obtaining, as the PESQ value, the value corresponding to the quantity of distortion from the differential spectrum. In the actual procedure for obtaining the PESQ by the above-mentioned Recommendation P.862, data is subjected to various other processing, but in this specification no description will be given of them and the entire procedure will hereinafter be referred to as a PESQ algorithm.

The speech signal received by the measurement interface part 101 from the test signal generator 210 via the system 100 is applied, as an impaired speech signal, to the listening quality measuring part 103, and at the same time the original speech signal is applied directly thereto as indicated by the broken line. The listening quality measuring part 103 calculates the speech quality evaluation value PESQ, as a listening quality impairment factor, from the two speech signals by the PESQ algorithm. In actual measurement, for example, pairs of short sentences (four) uttered by at least two males and two females are sent out a plurality of times from the test signal generating part 210 via the system 100 and sent directly to the listening quality measuring part 103, which obtains the PESQ value a plurality of times from plurality of received speech signals and outputs their mean value as the final speech quality evaluation value PRSQ. The listening quality evaluation value transforming part 105 transforms the PESQ value to a value on the R-value axis by the following equation defined in ITU-T Recommendation G.107 Appendix I.

$$R(target) = \frac{20}{3}\left(8 - \sqrt{226}\cos\left(h + \frac{\pi}{3}\right)\right) \tag{6}$$

where $$h = \frac{1}{3}\arctan2\left(18566 - 6750PESQ,\ 15\sqrt{-903533 + 1113960PESQ - 202500PESQ^2}\right)$$

$$\text{arc}ran2(x,\ y) = \begin{cases} \arctan(y/x) & \text{for } x \geq 0 \\ \pi - \arctan(y/-x) & \text{for } x < 0 \end{cases}$$

The R-value obtained by Eq. (6) is subtracted from the reference value to obtain the listening quality impairment factor value Ie,eff. More specifically, the following equation is calculated using, as the reference value, a value (87.8) obtained by substituting into Eq. (6) the mean of PESQ values for the signal coded by ITU-T Recommendation G.711 which is one of speech samples given by ITU-T P-series Recommendation Supplement 23.

$$Ie,eff=87.8-R(\text{target}) \tag{7}$$

Third Listening Quality Evaluation Method

In the above-described second listening quality evaluation method the original speech signal needs to be applied directly to the listening quality measuring part 103 from the test signal generating part 210, but the third listening quality evaluation method evaluates the listening quality of the speech signal by obtaining an evaluation value only from the signal received via the system 100 in the same manner as disclosed, for example, in Tetsuro YAMAZAKI and Hiroshi IRII, "Proposal of Objective Assessment Method for Telecommunication Speech Quality Using Pattern Recognition Technique," Technical Report of IEICE SP92-94, Nov. 1992, p. 17-34. In this case, the subjective evaluation of distorted speech is made in advance to obtain the frequency distribution of the opinion evaluation. Furthermore, reference patterns of acoustic parameters representing the distorted speech features, for instance, LPC cepstrum, are also made. The speech quality is estimated through utilization of the degree of likelihood between the reference patterns and that of the speech to be evaluated and the distribution of opinion evaluation points of the speech on which the reference patterns were made.

In this method, the speech signal to be evaluated, which is received by the measurement interface part 101, is subjected to LPC analysis in the listening quality measuring part 103 to obtain acoustic patterns of the LPC cepstrum as the listening quality impairment factor. The matching between the thus obtained acoustic patterns and the reference patterns is calculated to decide the reference pattern of the highest degree of likelihood. Then, the MOS value of the opinion evaluation points corresponding to that reference pattern is obtained.

Next, the listening quality evaluation transforming part 105 uses the MOS value as the PESQ value to calculate Eqs.

(6) and (7) to obtain the listening quality degradation Ie,eff as is the case with the second listening quality evaluation method described above.

Next, the interaction calculating part 106characteristic of the present invention follows predetermined rules to calculate the interaction values Iint between the delay-related degradation Idd and the listening quality degradation Ie,eff. The interaction will be described in detail later on. The adding part 106 adds together the delay-related degradation Idd, the listening quality degradation Ie,eff and the interaction value Iint, and outputs the added result as the overall degradation LQd. The overall speech quality estimating part 108 receives the overall degradation LQd from the adding part 107, then subtracts it from the reference value to obtain the psychological measure value (R-value), then calculates the MOS value by the following relation between the R-value and the MOS value shown in ITU-T Recommendation G.107 Annex B, and outputs the calculated MOS value as the subjective evaluation value.

$$MOS=1 \text{ for } R<0$$

$$MOS=1+0.035R+R(R-60)(100-R)7\times10^{-6} \text{ for } 0<R<100$$

$$\text{MOD}=4.5 \text{ for } R>100$$

A concrete description will be given below of the interaction that is introduced into the present invention.

In the prior art, the overall degradation of the delay-related impairment and the listening quality impairment is expressed as the sum of the two degradations as given by Eq. (1), but subjective evaluation tests reveal that in a region where the delay-related degradation and the listening quality degradation are both large, the overall degradation may sometimes be smaller than the sum of simple addition of the both degradations. This tendency is attributable to the effect that in the region where the one quality impairment is severe, the other quality impairment is masked psychologically, resulting in the overall degradation being made smaller than the sum of the two degradations.

Figure 2:
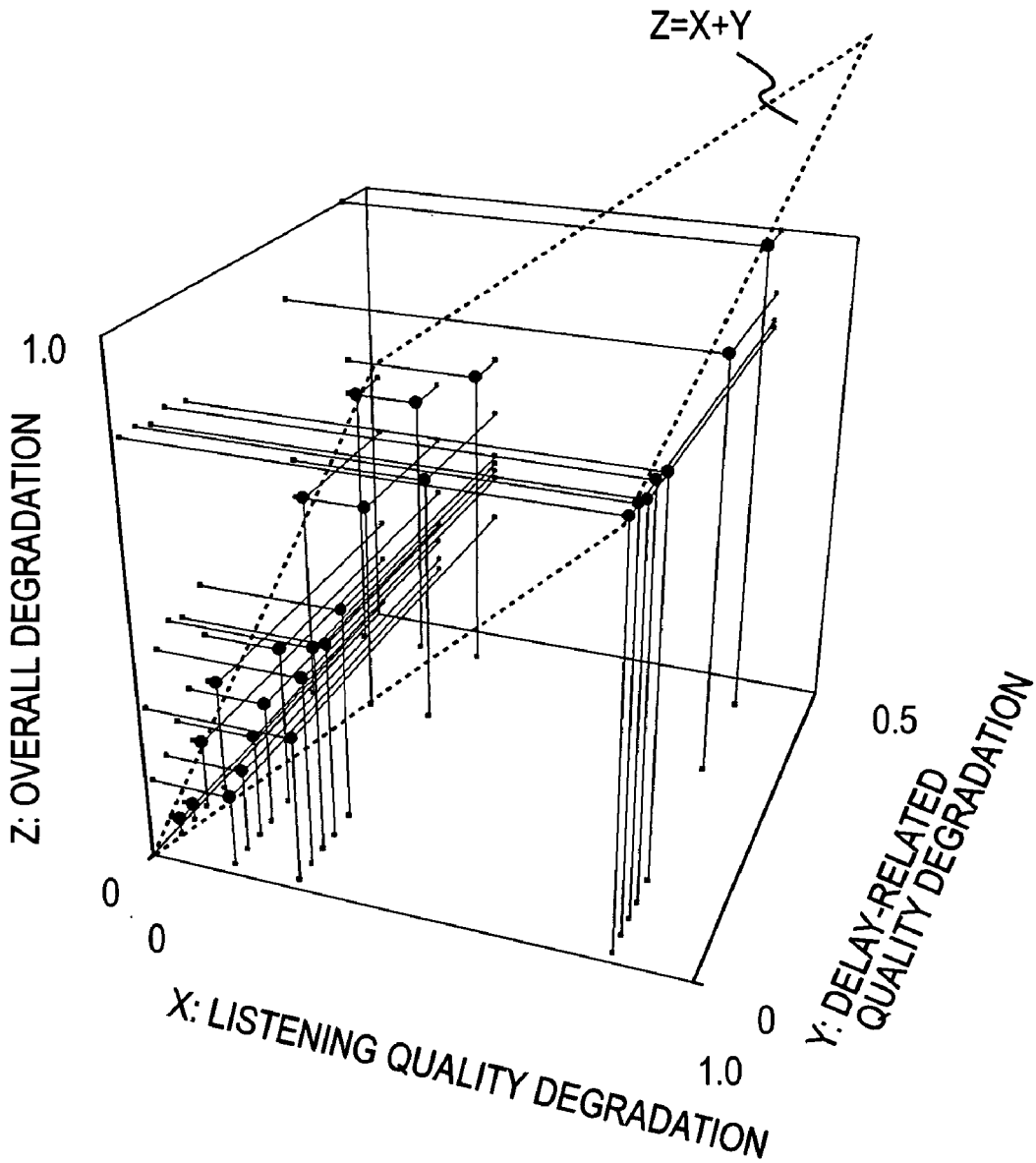
FIG. 2 is a diagram showing measured values of the overall degradation, taking into account an interaction between delay-related degradation and listening quality degradation according to the present invention.

FIG. 2 shows quantitatively measured values of the above effect based on subjective evaluation tests. The listening quality degradation X and the delay degradation Y are psychological degradations obtained from subjective evaluation results using only listening quality and delay as parameters. The overall degradation Z is the psychological degradation obtained from subjective evaluation results for the condition that listening quality and delay-related quality were impaired at the same time. The "psychological degradation" is defined by a value obtained by subtracting from a reference value the psychological measure value (R-value) to which the mean opinion score (MOS) defined in ITU-T Recommendation P.800 was transformed by the above-mentioned conversion equation (6) defined in ITU-T Recommendation G.107 Appendix I. The reference value is the R-value that was obtained when the MOS value for the condition without delay-related impairment and listening quality impairment was substituted for a variable PESQ in Eq. (6). Each degradation was normalized by the maximum value of the degradations obtained by the both subjective evaluation tests. For comparison, there are shown a Z=X+Y plane as an overall degradation by a conventional method.

In the region where X and Y are both sufficiently small, there is substantially no difference between the overall degradation Z by the conventional method and the overall degradation Z by this invention method that takes the interaction into consideration. In the region where X and Y are both large, the overall degradation by this invention method is smaller than the overall degradation by the conventional method. This means that the delay-related degradation and the listening quality degradation do not contribute to the overall degradation in the form of simple addition but mask each other.

A description will be given of the procedure for formulating the interaction.

The first step is to set a plurality of experimental conditions with different listening quality degradations and different delay-related quality degradations, after which the conversational opinion test defined in ITU-T Recommendation P.800 is conducted for each of the different conditions. The listening quality degradation is controlled, for example, by a method that changes the Q-value in MNRU (Modulated Noise Reference Unit) defined in ITU-T Recommendation P.810. The delay-related quality degradation can be controlled by inserting a delay generating device in the system under experiment and changing its delay. It is assumed there that the condition of zero delay is added for each Q-value condition.

Next, the listening quality degradation of the MNRU condition is determined. More specifically, the MOS value, which is obtained by the abovementioned conversational opinion tests for that one of the Q-value conditions which has no delay-related degradation (that is, the condition that the degradation is 0), is transformed to the R-value by the aforementioned transformation equation (6) defined in ITU-T Recommendation G.107 Appendix I. By subtracting degradations (for example, an echo degradation and side-tone degradation) other than the listening quality degradation from the R-value, the listening quality degradation for each Q-value condition in MNRU is determined.

Further, the following procedure is followed to quantify the interaction between the delay-related degradation and the listening quality degradation.

(a) Transform MOS values for all experimental conditions to R-values by the method described above.

(b) Calculate the "overall degradation of the listening quality degradation and the delay-related degradation" (that is, the sum of the listening quality degradation corresponding to each Q-value condition and the delay-related degradation corresponding to each delay time condition) computed based on the E-model.

(c) Use the R-value (92.486) corresponding to the condition that the delay is 0 and the Q-value is infinity (that is, the condition without the listening quality impairment) as the reference and subtract the value obtained in (a) from the R-value to obtain the "overall degradation of the listening quality degradation and the delay-related degradation" including the interaction.

(d) Subtract the value in (c) from the value in (b) to obtain the quantity of interaction corresponding to each experimental condition.

(e) Make a regression analysis using "listening quality degradation (X)" and the "delay-related degradation (Y)" as explanatory variables and the overall degradation (Z) in (d) as a target variable. In this embodiment, Z is approximated by a quadratic function with two unknowns to obtain the following equation.

$$Z=X+Y+XY(C_1-C_2X-C_3Y+C_4XY) \tag{8}$$

Where $C_1$, $C_2$, $C_3$ and $C_4$ are constants. By setting the overall degradation Z=LQd, the listening quality degradation Idd=X and the delay-related degradation Y=Ie,eff in Eq. (8), the overall degradation LQd is formulated. The interaction Iint is given by the following equation.

$$\text{Iint}=XY(C_1-C_2X-C_3Y+C_4XY) \tag{9}$$

Figure 3:
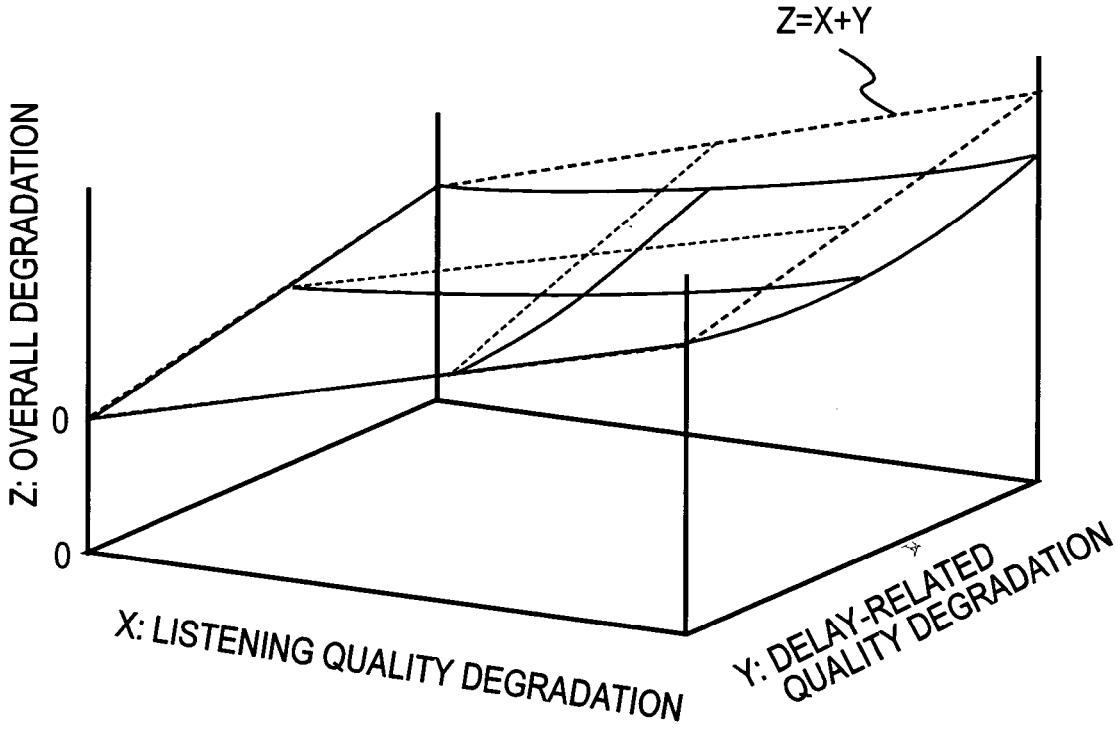
FIG. 3 is a conceptual diagram based on an equation expressing the overall degradation including the interaction.

As will be seen from Eq. (8), when substantially no listening quality degradation X exists, the overall degradation Z is given as the sum of the listening quality degradation X and the delay-related degradation A, but the effect of the interaction greatly increases with an increase in the listening quality degradation X. The same goes for the delay-related degradation. For a better understanding of the effect of the interaction described above with reference to FIG. 2, there are shown in FIG. 3 a calculated value of the overall degradation Z by Eq. (8) taking the interaction into account and the overall degradation Z=X+Y by the conventional method. In the case of using the constants $C_1$, $C_2$, $C_3$ and $C_4$ in Eq. (8) calculated from the measured results, in the region where the values X and Y are both large, the overall degradation Z by the present invention becomes smaller than the overall degradation Z=X+Y by the conventional method since the interaction value lint of Eq. (9) is negative.

Figure 4:
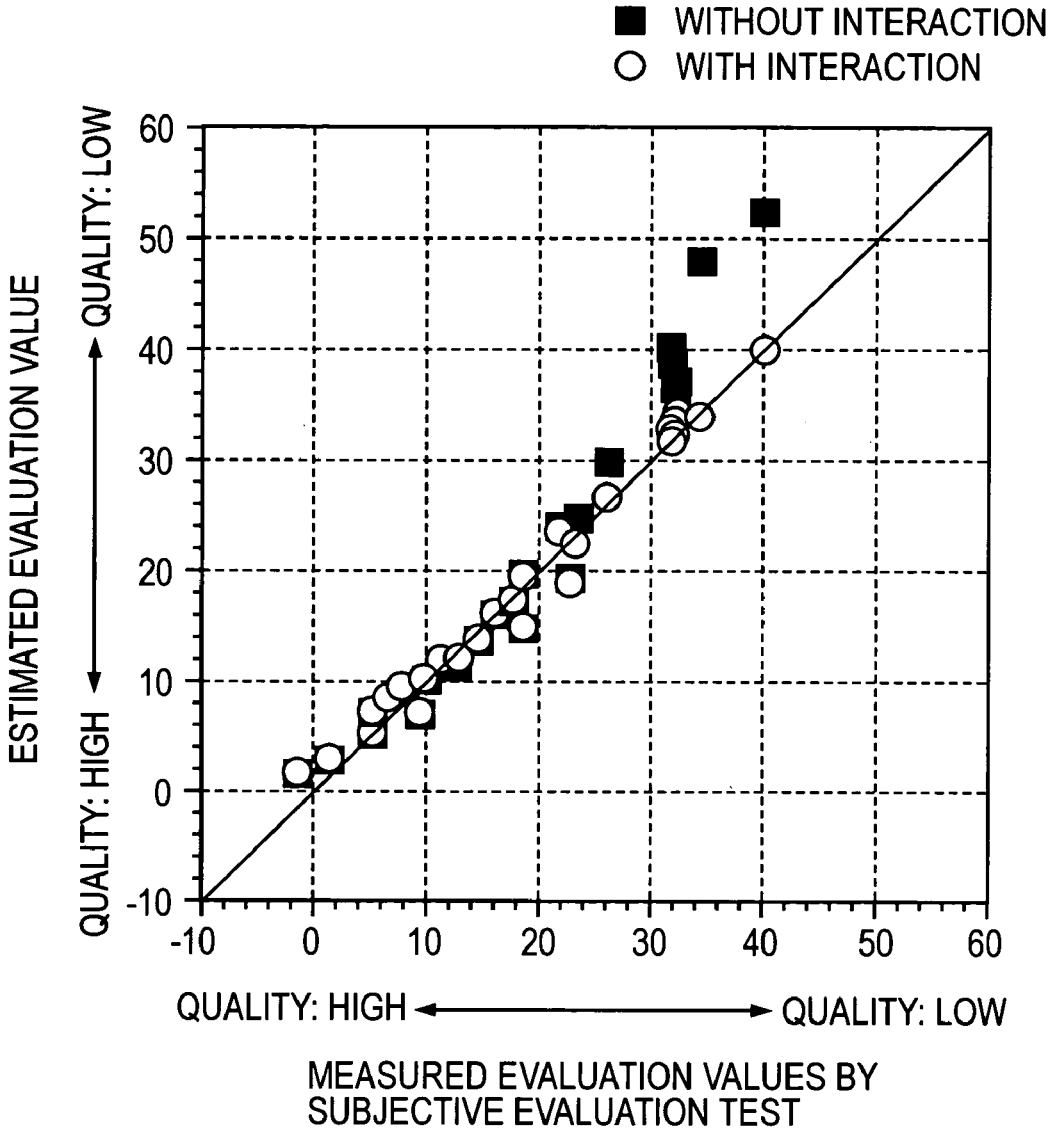
FIG. 4 is a graph showing the effect of the embodiment of the present invention.

FIG. 4 is a graph showing the effect of increasing the quality estimation accuracy by the present invention. The abscissa represents measured evaluation values obtained by subjective evaluation tests and the ordinate represents estimated evaluation values. The squares indicating measurement points are the results obtained by the E-model with no regard to the interaction and the circles are the results obtained by the present invention. From FIG. 4 it is seen that the evaluation values by the present invention are higher in accuracy than the evaluation values by the conventional method in the region where the quality degradation is large.

While the FIG. 1 embodiment has been described to obtain the overall quality evaluation of delay and listening quality, it is also possible to estimate the overall speech quality of other quality factors, such as echo and loudness, taking a similar interaction therebetween into consideration.

Figure 5:
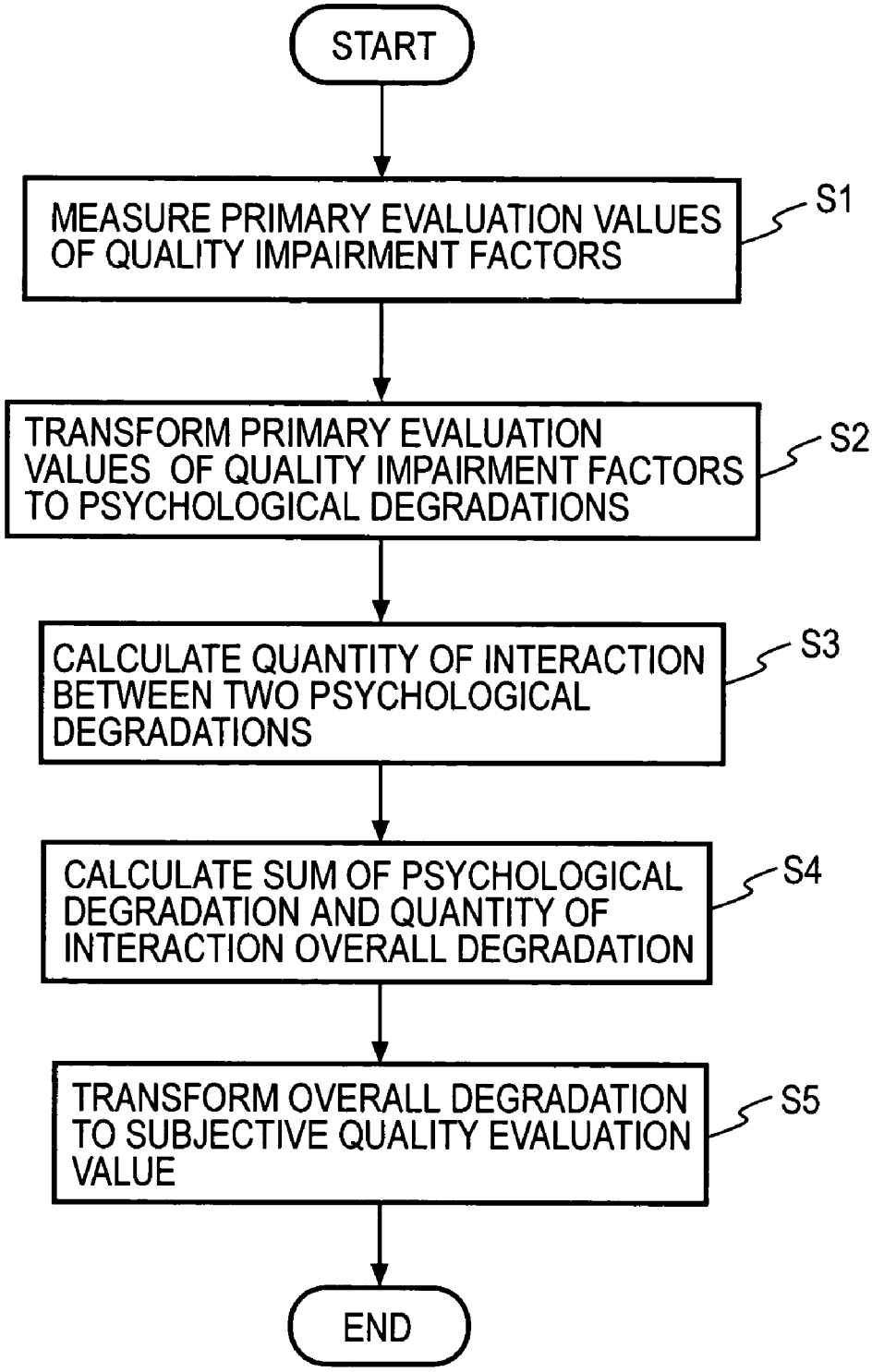
FIG. 5 is a flowchart showing the basic procedure of the overall speech quality estimating method according to the present invention.

FIG. 5 shows the procedure of the overall speech quality estimation method by the present invention described above.

Step S1:Measure the primary evaluation values of a plurality of quality impairment factors, for example, delay time and listening quality, by quality measuring means (delay time tome measuring part 102 and the listening quality measuring part 103).

Step S2:Transform the measured primary evaluation values to psychological degradations, for example, the delay-related degradation and the listening quality degradation by transforming means (the delay-related degradation evaluation value transforming part 104 and the listening quality evaluation value transforming part 105).

Step S3: Calculate the quantity of interaction between two psychological degradations (the delay-related degradation and the listening quality degradation) by the interaction calculating means (the interaction calculating part 106).

Step S4: Add the psychological degradations and the quantity of interaction by adding means (the adder 107) to obtain the overall degradation.

Step S5: Transform the overall degradation to the subjective quality evaluation value by the overall speech quality estimating means (the overall speech quality estimating part 108).

As described above, it is possible to estimate the speech quality with high accuracy by taking into consideration the interaction between psychological degradations of different quality impairment factors.

Embodiment 2

Figure 6:
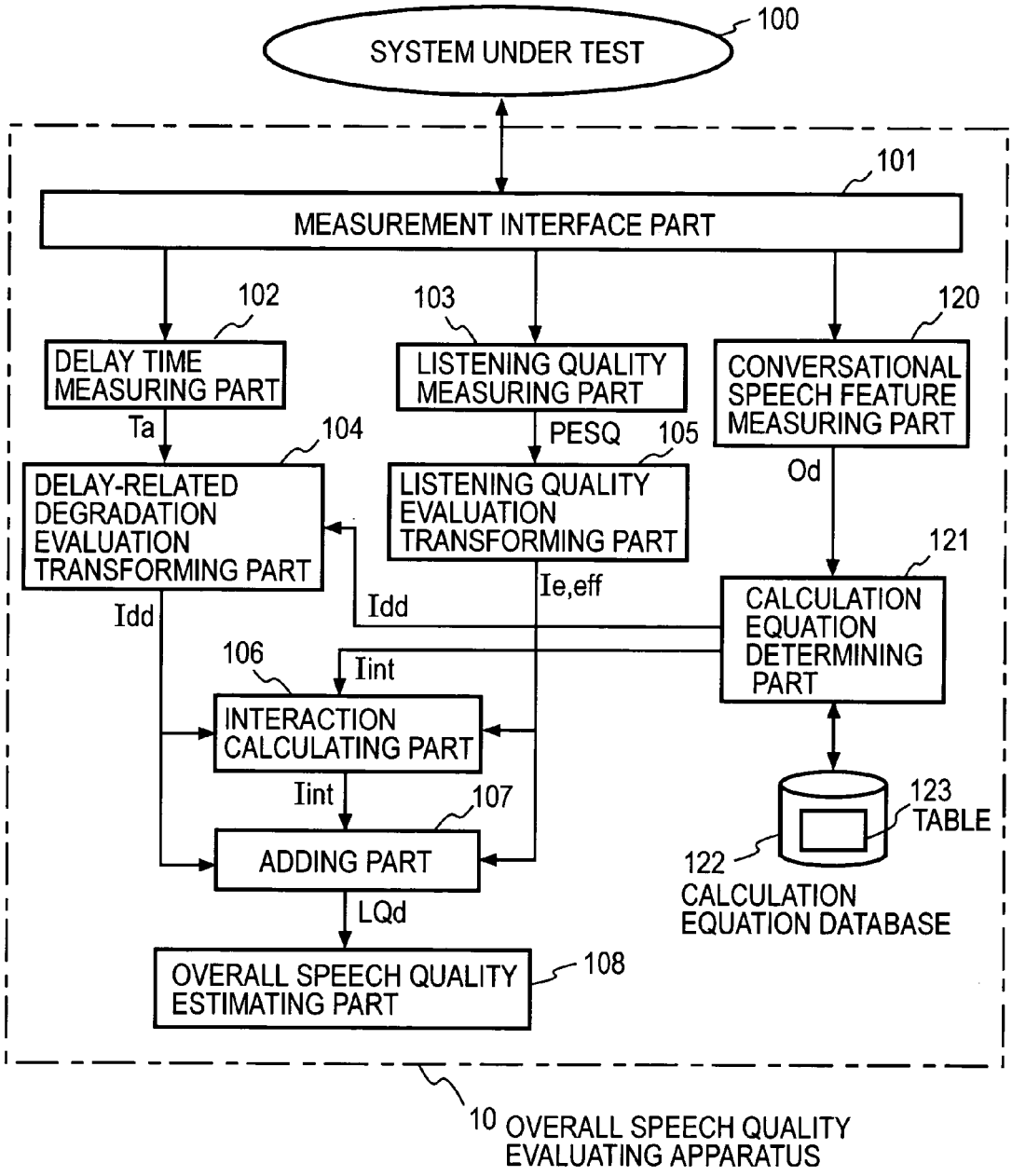
FIG. 6 is a block diagram illustrating a second embodiment of the present invention.

FIG. 6 is a block diagram illustrating the device configuration of a second embodiment for implementing the overall speech quality estimation method according to the present invention. This embodiment differs from Embodiment 1 in that the calculation equation in the interaction calculating part 106 is adaptively changed based on the feature that is observed from the actual speech signal. The part corresponding to those in FIG. 1 are identified by the same reference numerals.

Assume that the delay time measuring part 102 uses, as the received signal in the first delay time measuring method described previously in Embodiment 1, a signal sent from an arbitrary communication terminal (not shown) connected to the system under test 100, instead of using the signal sent from the test signal generator 210. It is also possible to employ the second or third delay time measuring method described previously in respect of the FIG. 1 embodiment. The listening quality measuring part 103 and the listening quality evaluation value transforming part 105 perform processing using either one of the first and third listening quality evaluation methods described previously with reference to the FIG. 1 embodiment.

A conversational feature measuring part 120 compares the temporal configurations of conversational speech signals in respective channels (up-link and down-link speech channels), thereby determining an objective measure representing the degree of interactivity in the communication concerned. As a concrete scheme it is possible to use, for instance, an objective evaluation measure Od proposed in Kenzou ITOH and Nobuhiko KITAWAKI, "Delay-Related Quality Evaluation Method Using Temporal Features of Conversational Speech," Journal of the Society of Acoustics Engineers of Japan, Col. 43, No. 11, April 1987, p.851-857. In the above document, since the delay-related degradation evaluation value and the listening quality evaluation value are affected by the utterance, pause, response speed and response frequency of the conversation, they are quantitatively analyzed, and the objective evaluation measure Od is defined by the following equation from the utterance time length mean Tp, its standard deviation Tps and the conversation exchange frequency Rn.

$$Od=Tp+TpsW_1+(1/Rn)W_2 \tag{10}$$

Where $W_1$ and $W_2$ are weighting coefficients.

The conversational feature measuring part 120 measures Tp, Tps and Rn from the conversational speech received via the system under test 100, and calculates the objective measure Od by Eq. (10). An interaction calculating equation and delay-related degradation evaluation transformation equation optimized in advance according to the magnitude of the objective measure Od are predetermined as follows:

$$Od \leqq T_1 : Int_1 = XY(C_{11} - C_{12}X - C_{13}Y + C_{14}XY) \text{ and } Idd_1 = f_1(Ta)$$

$$T_1 < Od \leqq T_2 : Int_2 = XY(C_{21} - C_{22}X - C_{23}Y + C_{24}XY) \text{ and } Idd_2 = f_2(Ta)$$

$$T_{n-1} < Od \leqq T_n : Int_n = XY(C_{n1} - C_{n2}X - C_{n3}Y + C_{n4}XY) \text{ and } Idd_n = f_n(Ta)$$

The sets of constants ($C_{11}$, . . ., $C_{14}$),($C_{21}$, . . ., $C_{24}$), . . ., ($C_{n1}$, . . ., $C_{n4}$) are optimized in advance corresponding to the objective measure Od. Similarly, a plurality of delay-related degradation evaluation value transformation equations $f_1$(Ta), . . ., $f_n$(Ta) are predetermined, for instance, by optimizing the set of constants (b1, b2) of Eq. (4) corresponding to the objective measure Od. The relations between the objective measure Od and the interaction calculating and delay-related degradation evaluation value transformation equations are prestored in a table 123 in a calculation equation database part 122. A calculation equation determining part 121 refers to the table 123 in the calculation equation database part 122 based on the objective measure Od provided from the conversational feature measuring part 120, then selects the interaction calculation equation Iint and the delay-related degradation evaluation value transformation equation Idd corresponding to the objective measure Od, and set them in the interaction calculating part 106 and the delay-related degradation evaluation value transformation part 104. The interaction calculating part 106, the adding part 107 and the overall speech quality estimation part 109 operate in the same manner as in the FIG. 1 embodiment. In the FIG. 6 embodiment, it is also possible that either one of the interaction calculating part and the delay-related degradation evaluation transformation part always uses a predetermined equation, whereas the other selectively uses an equation according to the objective measure Od.

The procedures of the overall speech quality estimation methods described with reference to Embodiments 1 and 2 of the present invention can be described as programs executable by the computer to allow it to carry out the present invention. Besides, the programs may be prerecorded on a recording medium readable by the computer and read out for execution as required.

Effect of the Invention

As described above, according to the overall speech quality estimation method of the present invention, it is possible to make an overall speech quality estimation that reflects the "interaction between quality factors" that has not been taken into consideration in the prior art, and consequently, the invention provides increased accuracy in the speech quality estimation.

What is claimed is:

1. A method for estimating the speech quality of a system under test that has a plurality of quality impairment factors, comprising:

(a) measuring primary evaluation values of said quality impairment factors of said system based on a signal received from said system;

(b) transforming the primary evaluation values of said quality impairment factors to psychological degradations;

(c) calculating the quantity of interaction between the psychological degradations by at least two of said plurality of quality impairment factors;

(d) calculating the sum of said psychological degradations and said quantity of interaction as an overall degradation; and (e) transforming said overall degradation to a subjective quality evaluation value.

2. The method of claim 1, wherein said quality impairment factors are at least two of delay, listening quality, echo and loudness.

3. The method of claim 1, wherein said step (c) includes:

obtaining said quantity of interaction by making a regression analysis using quadratic functions with two unknowns of a listening quality degradation and a delay-related degradation.

4. The method of claim 1, wherein said step (a) includes:

sending and receiving test signals via said system under test and measuring quality impairment factors.

5. The method of claim 1, wherein said system under test is an IP telephone communication path.

6. The method of claim 1, wherein said step (a) includes:

measuring said quality impairment factors from an actual speech signal received via said system under test.

7. The method of claim 6, wherein:

said step (a) includes measuring, as one of said primary evaluation values, the delay that is one of said quality impairment factors;

said step (c) includes measuring a conversational speech feature from said actual speech signal; and said step (b) includes selecting a transformation equation corresponding to said measured conversational speech feature from among a plurality of transformation equation predetermined in correspondence with conversational speech features, and calculating a delay-related degradation as one of said psychological degradations.

8. The method of claim 6 or 7, wherein said step (c) includes:

adaptively changing said quantity of interaction based on said conversational speech feature measured from said actual speech signal.

9. An overall speech quality estimation apparatus for estimating the speech quality of a system under test that has a plurality of quality impairment factors, said apparatus comprising:

quality measuring means for measuring primary evaluation values of said quality impairment factors of said system based on a signal received from said system;

transforming means for transforming said primary evaluation values of said quality impairment factors to psychological degradations;

quantity-of-interaction calculating means for calculating the quantity of interaction between said plurality of quality impairment factors from the output value from said transforming means;

adding means for adding said primary evaluation values and said quantity of interaction to obtain an overall degradation; and overall speech quality estimating means for transforming said overall degradation to a subjective quality evaluation value.

10. The apparatus of claim 9, wherein said quality measuring means includes a delay time measuring part for measuring a transmission delay time of said system under test based on a signal received from said system under test, and a listening quality measuring part for measuring the listening quality of said system under test.

11. The apparatus of claim 10, wherein said transforming means includes a delay-related degradation evaluating transformation part and a tone evaluation value transformation part for transforming the measured results by said delay time measuring part and said listening quality measuring part to a delay-related degradation and a listening quality degradation on the same quality measure, respectively.

12. The apparatus of claim 11, wherein said interaction calculating means includes means for obtaining said quantity of interaction by making a regression analysis using quadratic functions with two unknowns of said listening quality degradation and said delay-related degradation.

13. The apparatus of claim 9, said plurality of quality impairment factors are at least two of delay time, listening quality, echo and loudness.

14. The apparatus of claim 9, wherein said system under test is an IP telephony communication path.

15. The apparatus of claim 9, which further comprises a conversational speech feature measuring part for measuring conversational speech features based on conversational speech signals sent and received via said system under test, a database for prestoring a plurality of delay-related degradation evaluation value transformation equations predetermined in correspondence with conversational speech features, and a calculation equation determining part for selecting that one of said plurality of delay-related degradation evaluation transformation equations in said data which corresponds to said measured conversational speech feature, and wherein said quality measuring means includes a delay measuring part for measuring a delay amount as one of said quality impairment factors, and said transformation means calculates said measured delay-related degradation as one of said psychological degradations by said selected delay-related degradation evaluation transformation equation.

16. The apparatus of claim 15, wherein said database has a plurality of quantity-of-interaction calculation equations predetermined in correspondence with said conversational speech features, and said calculation equation determining part selects that one of said plurality of quantity-of-interaction calculation equations which corresponds to said measured conversational speech feature and sets said selected calculation equation in said interaction calculating means.

17. The apparatus of claim 9, further comprising: a conversational speech feature measuring part for measuring a conversational speech feature based on conversational speech signal sent and received via said system under test; a database for storing a plurality of interaction calculation equations predetermined in correspondence with conversational speech features; and a calculation equation determining part for selecting that one of said interaction calculation equations stored in said database which corresponds to said measured conversational speech feature and for setting said selected calculation equation in said interaction calculating means.

18. A computer-readable recording medium having recorded thereon a program for implementing said method of any one claims 1 to 7.

* * * * *

UNITED STATES PATENT AND TRADEMARK OFFICE

CERTIFICATE OF CORRECTION

PATENT NO. : 7,499,856 B2
APPLICATION NO. : 10/740642
DATED : March 3, 2009
INVENTOR(S) : Takahashi et al.

It is certified that error appears in the above-identified patent and that said Letters Patent is hereby corrected as shown below:

On the cover page,

Item [*] Notice: Subject to any disclaimer, the term of this patent is extended or adjusted under 35 USC 154(b) by 1088 days Delete the phrase "by 1088 days" and insert -- by 1470 days --

Signed and Sealed this

Fifteenth Day of June, 2010

David J. Kappos

David J. Kappos
*Director of the United States Patent and Trademark Office*